United States Patent [19]

Byrt

[11] 4,396,334

[45] Aug. 2, 1983

[54] SHEET STACKING APPARATUS

[75] Inventor: Graham A. B. Byrt, Bristol, England

[73] Assignee: Jagenberg-Werke A.G., Dusseldorf, Fed. Rep. of Germany

[21] Appl. No.: 251,822

[22] Filed: Apr. 7, 1981

[30] Foreign Application Priority Data

Apr. 10, 1980 [GB] United Kingdom ..... 8011880

[51] Int. Cl.[3] ..... B65G 57/22; B65H 31/36

[52] U.S. Cl. ..... 414/54; 271/189; 271/217

[58] Field of Search ..... 414/54; 271/85, 184, 271/189, 207, 213, 217, 218, 219

[56] References Cited

U.S. PATENT DOCUMENTS

| | | | |
|---|---|---|---|
| 2,950,108 | 8/1960 | Golding | 271/213 X |
| 3,298,683 | 1/1967 | Stroud | 271/189 X |
| 4,043,458 | 8/1977 | Schott, Jr. | 271/218 X |
| 4,162,649 | 7/1979 | Thornton | 271/218 X |
| 4,297,066 | 10/1981 | Ramcke et al. | 271/218 X |
| 4,311,475 | 1/1982 | Imai | 271/218 X |

FOREIGN PATENT DOCUMENTS

| | | | |
|---|---|---|---|
| 2328659 | 2/1975 | Fed. Rep. of Germany | 414/54 |

*Primary Examiner*—Robert J. Spar
*Assistant Examiner*—Janice Krizek
*Attorney, Agent, or Firm*—Seidel, Gonda & Goldhammer

[57] ABSTRACT

A stack (S) of sheets is formed on a downwardly moving platform (4), the stack being divided into portions (P) each consisting of a predetermined number of sheets. As each alternate portion is completed, that portion is gripped between two plates (5, 20) and moved horizontally so that it is offset relative to the portion next below it.

A completed stack containing the required number of portions is separated from the rest of the stack by inserting a divider (40) at the desired position. The platform (4) is then moved to remove those portions below the divider and, at the same time, an auxiliary support (41) moves beneath the divider (40) to support the stack above. The completed stack is removed from the platform (4) which is then raised level with the support (41). The divider (40), support (41) and platform (4) move together so that the stack is again supported on the platform (4).

8 Claims, 16 Drawing Figures

SHEET STACKING APPARATUS

Figure 1:
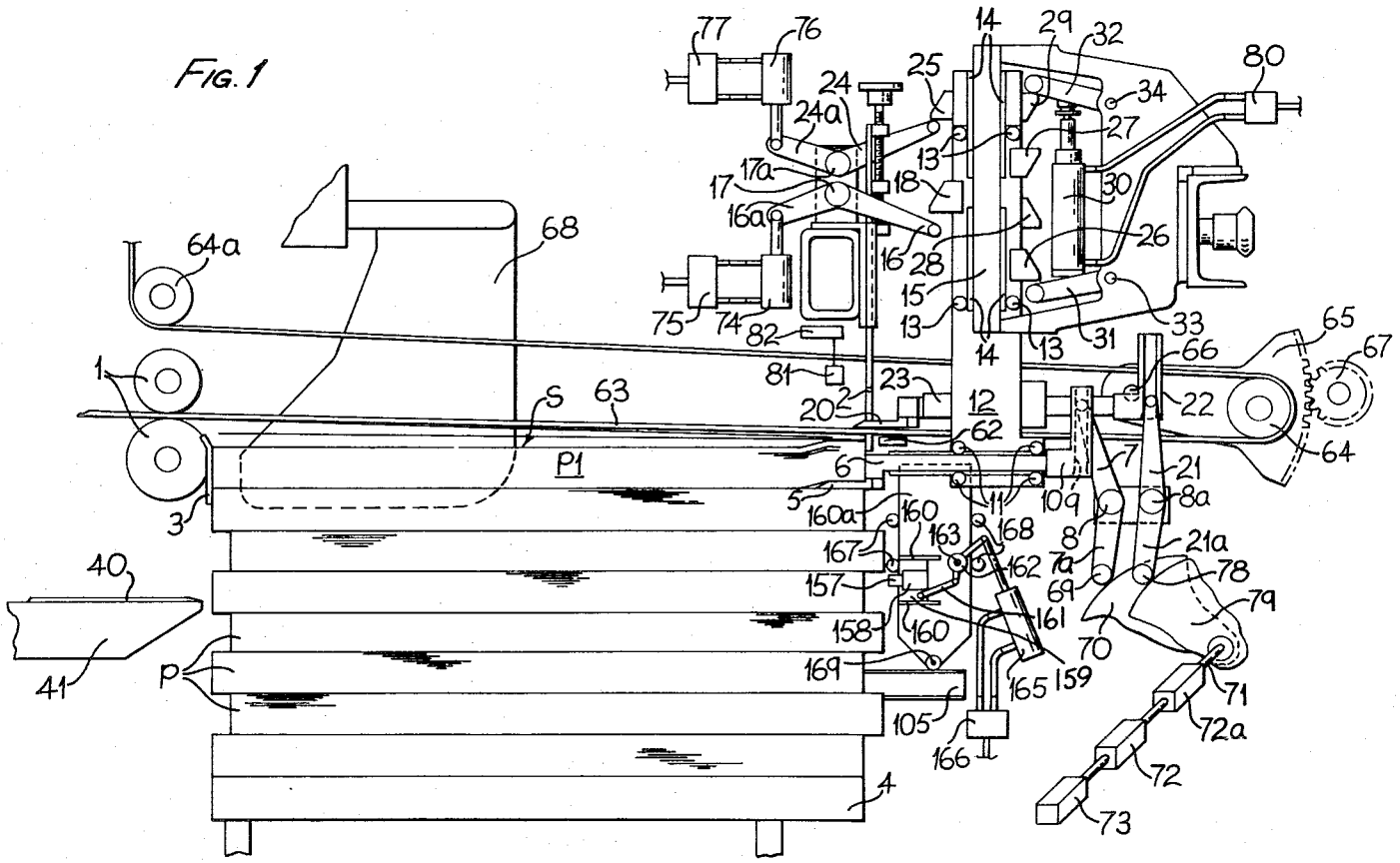

This invention concerns improvements in or relating to apparatus for forming a stack from a succession of sheets of, for example, paper.

It is usual for sheets to be formed into large stacks either by a delivery unit which is raised in unison with the growing stack or more usually the sheets are collected on a platform or table which descends at the growing rate of the stack. These stacks are often required to be separated into smaller batches or portions (e.g. a ream of 500 sheets) for feeding to machines for carrying out further operations such as wrapping the reams in an outer wrapper.

The individual batches contained in a stack are commonly marked by inserting paper tabs at appropriate positions. These stacks are then separated into the required batches manually, which is rather time consuming. A disadvantage of the tab system is that the tabs can become disturbed and the benefit of marking the batches is lost. Where other more substantial devices are used to mark the stack, e.g. angle strips, then these must be moved around the factory either manually or automatically.

It is also known to divide a stack as it is being formed into batches and remove the lowermost batch, whilst the rest of the stack is being supported by an auxiliary support, for feeding to apparatus for carrying out further operations on each batch.

According to the invention there is provided apparatus for forming a stack from a succession of sheets, including support means on which said stack is formed, means for feeding said sheets in succession onto said support means, stop means for arresting lengthwise motion of said sheets whilst being fed onto said support means, characterised by gripping means for gripping a portion of said stack, and first means for moving said grippng means to offset the gripped portion relative to the next adjacent portion of the stack.

Preferably the apparatus may include second means for moving said support means downwards as the stack grows, to keep the top of the stack at a constant level.

In a preferred form the gripping means may comprise first and second gripper plate means, third moving means for moving said gripper plate means vertically, said first and third moving means being operable to move each gripper plate means independently along similar closed paths in a vertical plane so that each gripper plate means moves in succession into said stack, downwards with said stack, out of said stack and upwards, the motions of the gripper plate means being out of phase so that in alternation each gripper plate means changes its vertical position relative to the other gripper plate means, each gripper plate means alternately becoming the upper and lower one.

A required number of portions may be removed from beneath the rest of the stack by moving the support means horizontally and supportng the rest of the stack on auxiliary support means.

A microprocessor may be used for controlling the operation of the moving means in a predetermined timed sequence.

Figure 2A:
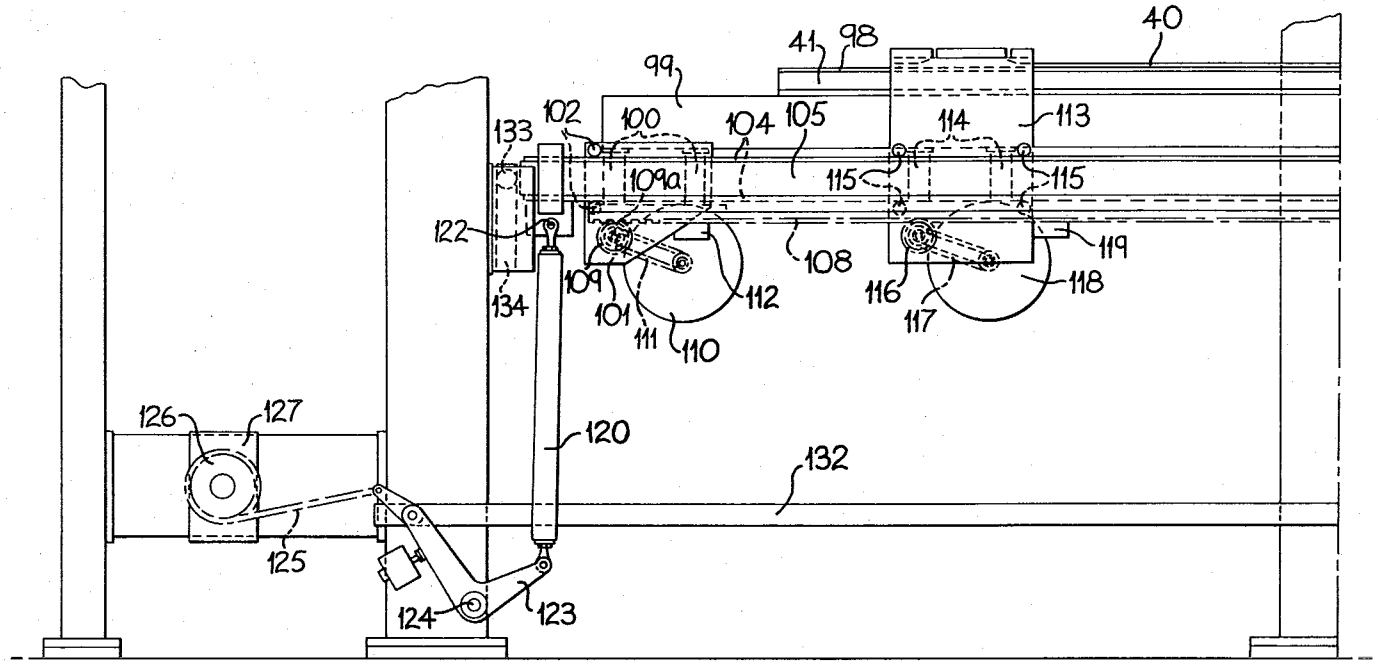
Figure 2B:
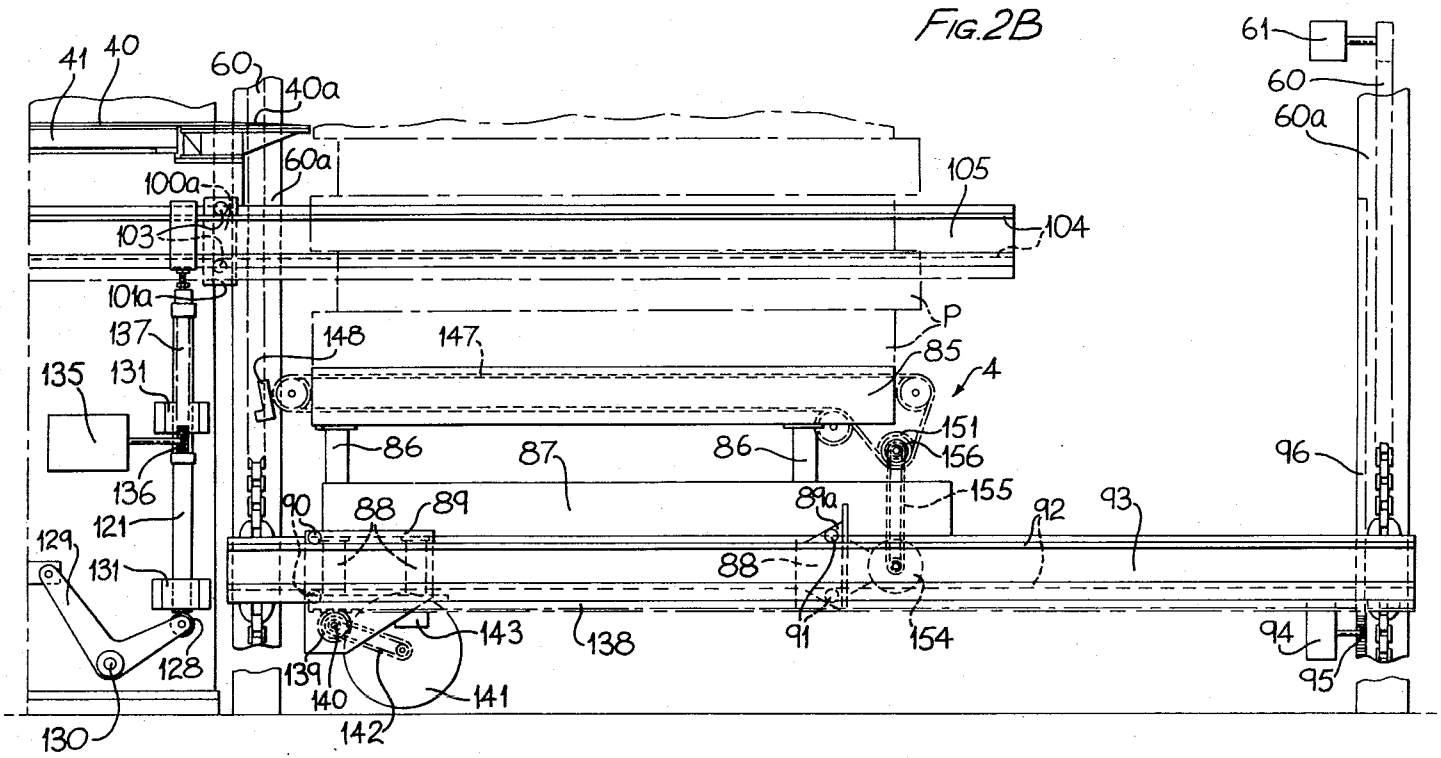
Figure 8:
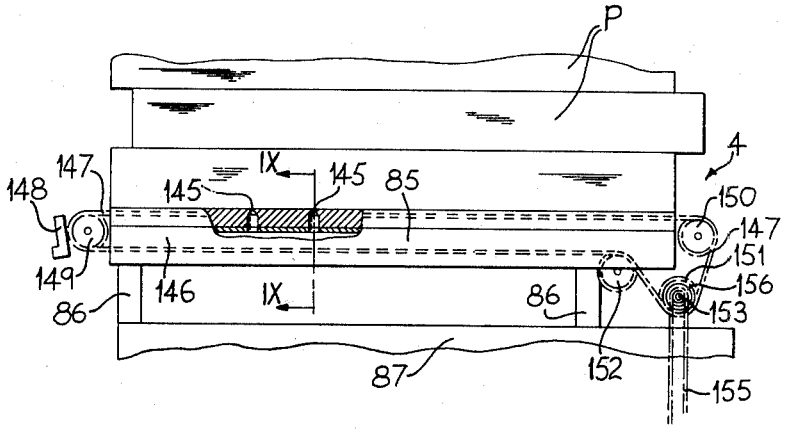
Figure 9:
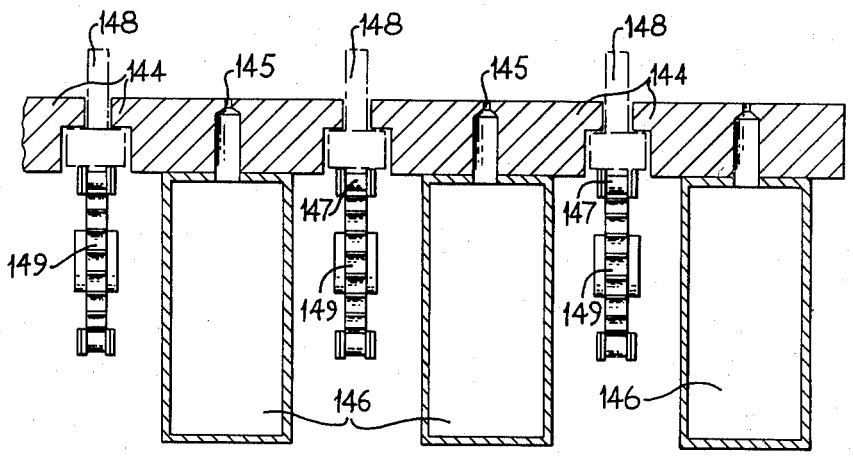
Figure 14:
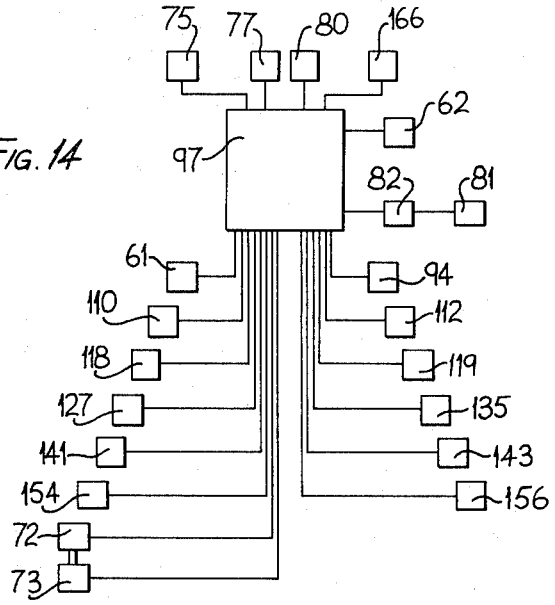
Figure 15:
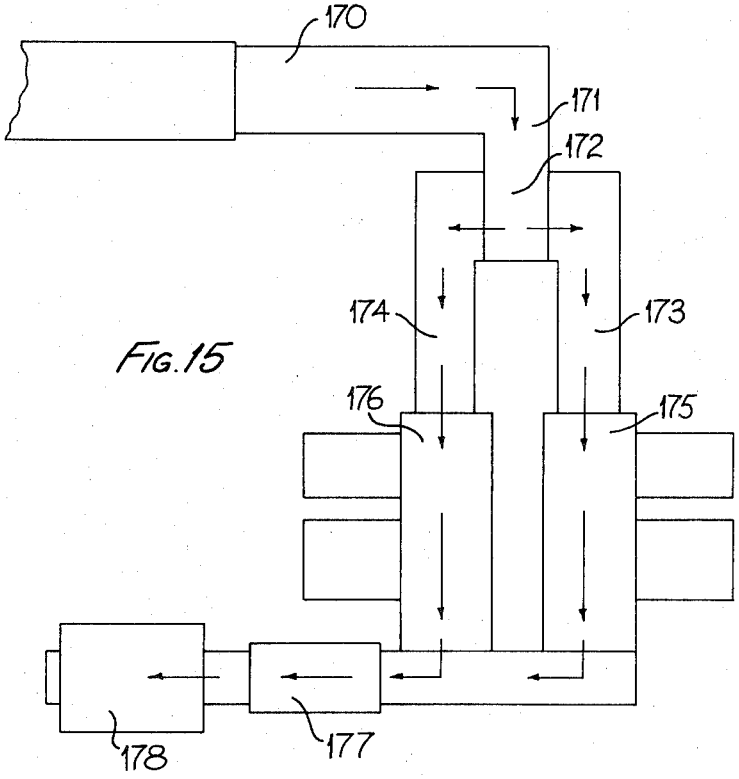

The invention will now be described by way of example only with reference to the accompanying drawings in which:

FIG. 1 is a diagrammatic side view of stack forming apparatus according to the invention, FIGS. 2A and 2B together form a diagrammatic side view of apparatus for supporting a stack formed on the apparatus of FIG. 1 and for removing that stack from the apparatus, FIGS. 3 to 7 are diagrammatic views of part of the apparatus of FIG. 1 showing some of the parts at successive stages in the forming of a stack, FIG. 8 is a side view, partly in section, of a support platform on which a stack is formed, FIG. 9 is a section taken on the line IX—IX of FIG. 8, and drawn to a larger scale, FIGS. 10 to 13 show successive stages of the removal of a completed stack from the apparatus, FIG. 14 is a block diagram of the circuits for controlling the operation of the apparatus, and FIG. 15 is a diagrammatic showing of a layout of machines for forming and handling stacks.

Referring to FIGS. 1, 2A, 2B and 14, a stream of overlapped sheets is fed to the right by a pair of cooperating rollers 1 and on leaving the nip of these rollers each sheet travels further to the right above a stack S, in the course of formation, until it strikes a stop means in the form of a backboard 2, whereupon the sheet falls on top of the stack. The left hand edge of the stack is kept in alignment by known vibrating plates 3.

The stack is formed on a support platform 4 comprising a table 85 (to be described in more detail later) which extends across the width of the machine and is carried on a pair of cross members 86 supported at each end on beams 87, one such beam being provided on each side of the machine. The beams 87 are supported on further cross members 88 which support plates 89, **89*a* on each side of the machine. The plates 89, 89*a* are provided respectively with wheels 90, 91 which run on rails 92 fixed to carrier beams 93. The latter each have a chain 60 attached to each end thereof, which thus supports the platform 4. The platform 4 is raised and lowered by the chains 60 (FIG. 2B), which are driven in known manner by a motor 61, the table being constrained to move in a vertical path by guides 60*a*. During stack formation the platform is lowered a short distance at a time, under the control of a photoelectric stack height sensor 62 (FIG. 1), of any suitable type, so that the top of the stack S is maintained at optimum spacing below the path of sheets from rollers 1 to the backboard 2. Vertical movement of the platform 4 is detected by a positional transducer 94 (FIG. 2B), of any convenient type, which is fixed on the rail 93. A pinion 95, engaging a rack 96 fixed to one of the guides 60*a*, rotates as the platform 4 moves, and the transducer 94 emits pulses, as the pinion rotates, indicative of the vertical position of the platform, which pulses are fed to a central microprocessor control unit 97 (FIG. 14) referred to later; the motor 61 also being connected thereto. Tapes 63, which pass round pulleys 64, 64*a*, extend across the top of the stack, in known manner, to ensure that the sheets are fed correctly to the top of the stack. In order that the tapes 63 can be correctly positioned for different length sheets, which require the backboard 2 to be in a different position to that shown, the pulley 64 is mounted on a toothed quadrant 65, pivoted at 66, and meshing with a gear 67. The latter is rotated to move the quadrant about its pivot, and thus move the pulley 64 up or down depending on the required position of the tapes 63**.

Although only one stack S is shown, it should be noted that a number of stacks may be formed simultaneously across the width of the machine, the sides of adjacent stacks being kept in alignment by vibrating plates 68 of known type.

As the sheets are fed on to the stack their leading edges are detected by a photoelectric detector 81 which, for each sheet, emits a pulse which is fed to a counter 82 and moves the count up by one. The counter emits pulses, indicative of the count, which are fed to the unit 97. It is common, in machines of this type, to feed the sheets as "spurs" (i.e. a number of superimposed sheets). In this case the counter 82 would be arranged to move up by the number of sheets in the "spur" each time a pulse is emitted from detector 81.

As the stack is formed it is divided into portions P, alternate portions being offset to the right from the portion next below in the stack. The formation and offsetting of alternate portions of the stack will now be described with additional reference to FIGS. 3 to 7.

The portion P1 is separated, at the right hand end thereof, from the portion P below it by a number of gripper plates 5 spaced across the stack, only one being visible. Each gripper 5 is carried by an arm 6 which is moved, at predetermined times, backwards and forwards horizontally by means of a lever 7 fixed on a rotatable shaft 8. The lever 7 carries a roller which runs in a vertical channel 9 formed in an extension 10 of the arm 6. An arm *7a*, also fixed on the shaft 8, carries a cam follower 69 which engages with a cam 70 fixed to a shaft 71 driven from the output side of a single-revolution clutch 72 through a reduction gearbox *72a*, so that the shaft 71 rotates through 90° for each revolution of the output side of the clutch 72. The input side of the clutch is driven continuously by a motor 73. For clarity, the shaft 71, gearbox *72a*, clutch 72 and motor 73 are shown in perspective in this figure. The clutch 72 is operated, under the control of unit 97, to drive the end of shaft 71 carrying the cam 70 at certain times, to move the gripper plate 5 into and out of the stack S, as will be described later. The arm 6 is constrained to move in a horizontal plane by rollers 11 mounted on a vertical support 12 which itself is movable in a vertical plane on rollers 13 which run on rails 14 carried on a fixed support 15. The support 12, and thus also the gripper 5, are raised by a lever 16, which is fixed, at one end, on a rotatable shaft 17. The other end of lever 16 contacts the bottom surface of a block 18 fixed to the support 12. A lever *16a*, also fixed to shaft 17, is attached to the piston of a pneumatic cylinder 74, air being fed to the cylinder at appropriate times via an electromagnetic valve 75, which is connected to, and operated under the control of unit 97. The support 12 lowers by reason of its own weight as will be described later.

Above each gripper plate 5 is a second gripper plate 20 which is movable horizontally and vertically, independently of the gripper plate 5, in a similar manner to the plate 5. Each gripper 20 is moved horizontally by a lever 21, vertical channel 22 and arm 23 which correspond respectively to the lever 7, vertical channel 9 and arm 6, the lever 21 being fixed to a rotatable shaft *8a*. A lever *21a*, also fixed to a shaft *8a*, carries a cam follower 78 which engages with a cam 79, similar to the cam 70, and also fixed to the shaft 71, so that the cams 70, 79 rotate stepwise in unison but out of phase. The upward movement of plate 20 is obtained from a lever 24 which, at one end thereof, contacts a block 25 fixed to a support (not shown) similar to support 12, the other end being fixed to a rotatable shaft *17a*. The plate 20 moves downwards by reason of its own weight. A lever *24a*, also fixed to shaft *17a*, is attached to the piston of a pneumatic cylinder 76. The lever 24, as with the lever 16, is operated at appropriate times by the pneumatic cylinder 76, air being fed thereto via a electromagnetic valve 77, which is also connected to, and operated under the control of, unit 97.

The support 12 also carries a pair of further blocks 26, 27 and, similarly, the support plate associated with the gripper 20 also carries a pair of further blocks 28, 29.

The grippers 5, 20 are chamfered at their left hand edges and are so constructed that air under pressure may be fed out through apertures in their left hand edges to provide a layer of air between the surfaces of the sheets between which they are moved, as will be described later.

A pneumatic cylinder 30, to which air is fed via an electromagnetic valve 80, extends between two levers 31, 32 mounted on fixed pivots 33, 34 respectively. The free ends of the levers 31, 32 are arranged to contact respectively the blocks 26 and 29 or 28 and 27, depending on the relative positions of the blocks, 18, 25, so as to urge the grippers 5, 20 towards each other, as will be described later.

The control unit 97 is a microprocessor which, in known manner, controls the motors 61, 73, clutch 72 and valves 75, 77 and 80 according to a pre-set program so that the various operations take place in the correct sequence and at the correct time, as will now be described.

A number of pairs of gripper plates 5, 20 are provided, spaced apart across the width of each stack being formed. Each pair is operated by separate levers, corresponding to levers 7, 21, 16, 24 which are fixed to respective shafts 8, *8a*, 17, *17a*. However, a separate cylinder, corresponding to cylinder 30 is provided for each pair of grippers 5, 20.

When the count in counter 82 reaches the required number of sheets to form the portion P1, the gripper plate 20 is lowered on to the top of the portion P1, by the valve 77 being operated so that the cyinder 76 moves the lever 24 clockwise about its pivot. When the gripper 20 contacts the top of portion P1 the lever 24 continues its clockwise movement and moves away from the block 25. Also, at this time, the lever 16 is away from the block 18. The grippers 5, 20 are now supported only by the stack and will thus move downwards, under their own weight, in unison with the stack.

Figure 3:
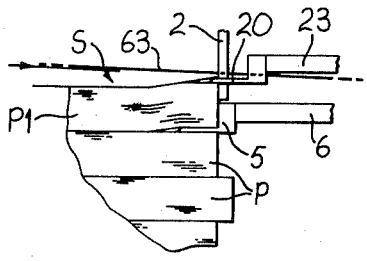
Figure 4:
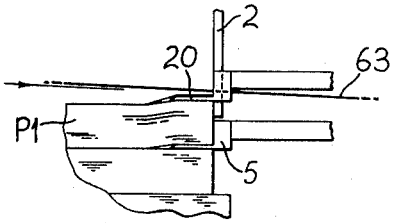

The leading edge of the next succeeding sheet will thus now rest on top of the gripper plate 20 (FIG. 3). When several sheets have been delivered on top of the gripper 20, the clutch 72 is energised to rotate the cams 70, 79, so that the lever 21 is operated to move the gripper 20 to the left to insert it further into the stack to a position similar to the gripper 5(FIG. 4), the clutch then being de-energised. Depending on the material of the sheets and to ensure that the sheets, which will form a portion on top of the portion P1, do not foul the edge of the gripper 20, air may be blown out of its leading edge.

The valve 80 is now operated so that cylinder 30 moves the levers 31, 32 about their pivots so as to apply pressure to the blocks 26, 29 respectively which urge the support plate 12 upwards, and the support plate associated with the divider plate 20, downwards, thus urging the grippers 5 and 20 together so that they firmly grip the portion P1 between them.

Figure 5:
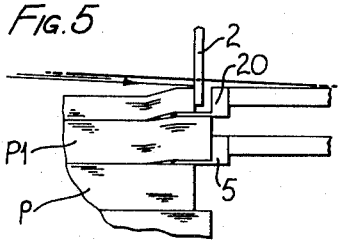
Figure 6:
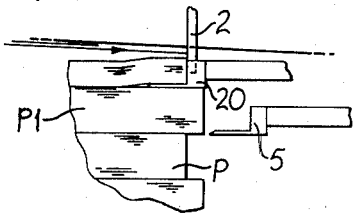
Figure 7:
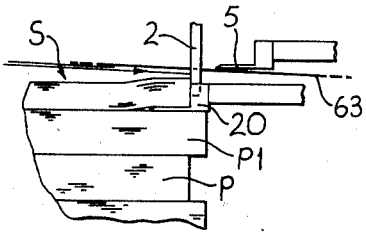

When sufficient sheets have been delivered on top of the stack S so that the gripper 20 has been lowered to a position in which it is clear of the bottom of the backboard 2, the clutch 72 is energised to rotate the cams 70, 79 so that the levers 7, 21 are operated to move the grippers 5 and 20, and therefore also the portion P1, to the right a predetermined distance, thus producing a step in the stack (FIG. 5). The clutch 72 is then de-energised. At the same time air is blown from the front of both grippers 5 and 20 to lubricate the sheets above and below the portion P1 to ensure easy movement. The valve 80 is now operated so that cylinder 30 moves the levers 31, 32 to release the grip of the grippers 5, 20. The clutch 72 is energised so as to rotate the cams 70, 79 to move the gripper 20 to the left so that it again extends fully into the stack (FIG. 6).

The gripper 5 is now fully withdrawn from the stack (FIG. 6) by operation of the lever 7 by cam 70, and the clutch 72 is de-energised. The gripper 5 is raised to a position above the level of the top of the stack S (FIG. 7), by operation of the lever 16, which is caused to move anticlockwise about its pivot by cylinder 74 on operation of the valve 75. The clutch 72 is then again energised to cause operation of the lever 7 so that the gripper 5 is moved to the left to the position occupied by the gripper 20 in FIG. 1.

The formation of the next portion P in the stack S is the same as just described in relation to the portion P1 with the exception that the positions of the grippers 5 and 20 are reversed and the valve 80 is not operated to cause the cylinders 30 to urge them together and they thus do not grip the portion between them. Thus this portion is not offset to the right as was the portion P1.

It will be understood that the gripper plates need not always grip and offset every alternate portion. A number of successive alternate portions may be offset or not, depending on the arrangement required in the stack, the operations required to produce the stack being controlled from a suitable program in the unit 97.

When a required number of portions P have been formed as described above to give a completed stack, the stack is removed from the apparatus as will now be described with reference to FIGS. 1, 2A, 2B, 8, 9, 14. The separation is effected by a divider 40, formed from a thin hollow member having an angled front portion 40*a* (FIG. 2B), and provided with apertures (not shown) through which pressure air is fed to form a layer of air on its surfaces.

The divider 40 comprises a number of hollow members spaced apart across the machine, only one being visible. It is supported on an auxiliary support in the form of a movable support tale 41, the divider 40 and table 41 being movable both horizontally and vertically as will be described later. A layer 98 of low friction material is provided between them to allow relative lengthwise movement therebetween. The table 41, which also consists of a number of spaced members, is supported, at each side of the machine, by a beam 99. The latter are supported on cross members 100, 100*a* to which plates 101, 101*a* are respectively fixed, on each side of the machine, the plates being provided respectively with wheels 102, 103 which run on rails 104 fixed to long carrier beams 105. Fixed to each of the beams 105 is a toothed rack 108 which are engaged by gear wheels 109 carried on a cross shaft 109*a* journalled in the plates 101. Carried on the cross members 100 is a motor 110 drivingly connected to the shaft 109*a* by a chain 111. The motor 110 is controlled by the unit 97, so that at the appropriate times the motor is operated to rotate the gear 109 and thus move the table 41 towards and away from the stack, as will be described. Movement of the table is detected by a positional transducer 112 which is fixed to the plate 101 and emits pulses, indicative of the horizontal position of the table 41, which are fed to the unit 97.

The divider 40 is fixed at each side of the machine to a plate 113, the latter being joined also by cross members 114. Each plate 113 is provided with wheels 115 which run on the rails 104. The divider 40 is moved, at appropriate times, into and out of the stack by a gear 116 which engages the rack 108 and is driven by a chain 114 from a motor 118. The latter is controlled from the unit 97 and the horizontal position of the divider is detected by a positional transducer 119, similar to the transducer 112, fixed to the plate 113.

At certain times the divider 40 and table 41 are moved vertically, and for this movement the carrier beams 105 are each supported, at the left hand end, by a connecting rod 120, and about halfway along their lengths by a support rod 121. The upper end of rod 120 is loosely connected, at 122 to the beam 105 and the lower end is pivotally connected to one arm of a bell-crank lever 123, mounted on a fixed pivot 124. The other arm of the lever 123 is fixed at its free end to a chain 125 which engages a sprocket 126 fixed on the shaft of a motor 127, controlled by unit 97.

The beam 105 rests on top of the rod 121, the lower end of which contacts a roller 128 carried on one arm of a further bell-crank lever 129 mounted on a fixed pivot 130. The rod 121 is constrained to move vertically by guides 131. The other arm of lever 129 is connected to one end of a bar 132, the other end of which is connected to the other arm of the lever 123. The left hand end of the beam 105 carries a roller 133 which runs in a fixed track 134, to guide the beam in a vertical path. The arrangement is such that when the motor 127 is operated, the levers 123, 129 rotate on their respective pivots to move the divider 40 and table 41 vertically. This movement is detected by a positional transducer 135 mounted on a fixed part of the machine, and having a pinion 136 which engages a rack 137 on the rod 121. Movement of the latter rotates the pinion and the transducer emits pulses, indicative of the vertical position of the divider 40 and table 41, which are fed to the unit 97.

Fixed to each of the beams 93 (FIG. 2B) is a rack 138 which are engaged by gear wheels 139 rotatably carried on a cross-shaft 140 journalled in the plates 89. The gears 139 are driven from a motor 141 by a chain 142 so as to move the platform 4 horizontally, as will be described later, such movement being detected by a positional transducer 143 which is operated to send pulses, indicative of the horizontal position of the platform 4, to the unit 97.

To enable the completed stack to be removed from the platform 4, the table 85 comprises a number of slats 144 (FIGS. 8, 9) spaced apart across the width of the table, each slat being provided with a row of apertures 145 in its upper surface. The apertures in each slat communicate with a hollow chamber 146, one such chamber being provided for each slat. Air under pressure is supplied at appropriate times, from a pump (not shown), to the chambers 146 and out through the apertures 145.

An endless chain conveyor 147 is provided in each of the spaces between adjacent slats 144. Each chain 146 carries a single pusher 148 positioned so that all the pushers are in alignment across the table 85. Each conveyor 147 passes over sprockets 149, 150, 151 and 152, all the sprockets 151 being mounted on a common shaft 153. The latter is driven by a chain 155 from a motor 154, fixed on one of the cross members 88.

Whilst a stack is being formed on the table 85 the pushers 148 are stationary in the position shown in FIG. 8. The motor 154 is operated at certain times, by the unit 97, to drive the conveyors 147 in a clockwise direction and the pushers 148 push the completed stack off the table 85, the position of the pushers 148 being indicated to the unit 97 by pulses emitted by a positional transducer 156 mounted on the shaft 153.

To prevent undesirable movement of the portion P above the portion forming the top of a completed stack, as the divider 40 is inserted into the stack, and the completed stack removed, blocking means, in the form of a pad 157 (FIG. 1) is provided. The pad is fixed to a cross member 158 having a plate 159 attached to each end thereof, only one plate being visible, and being slideable between horizontal guide rails 160 carried on a side plate 160*a*. The plates 159 and thus also the pad 157, are moved by an arm 161 connected to one arm of a bell-crank lever 162, pivoted at 163, the other arm of which is connected to the piston rod of a pneumatic cylinder 165. The latter is supplied with air via a valve 166 under the control of the unit 97. Whilst the pad 157 is in contact with the stack it is moved downwards in unison therewith. For this movement the plate 160*a* runs between wheels 167, 168 carried on a fixed part of the machine, and the movement is derived from the carrier beam 105, on which runs a wheel 169 mounted on an extension of the plate 160*a*. Thus the pad 157 is moved upwards by the beam 105 and downwards under the weight of the plate 160*a* and the attached parts, as the beam 105 so moves.

The operation of the apparatus for removing a completed stack from the machine will now be described with added reference to FIGS. 10 to 13.

Figure 10:
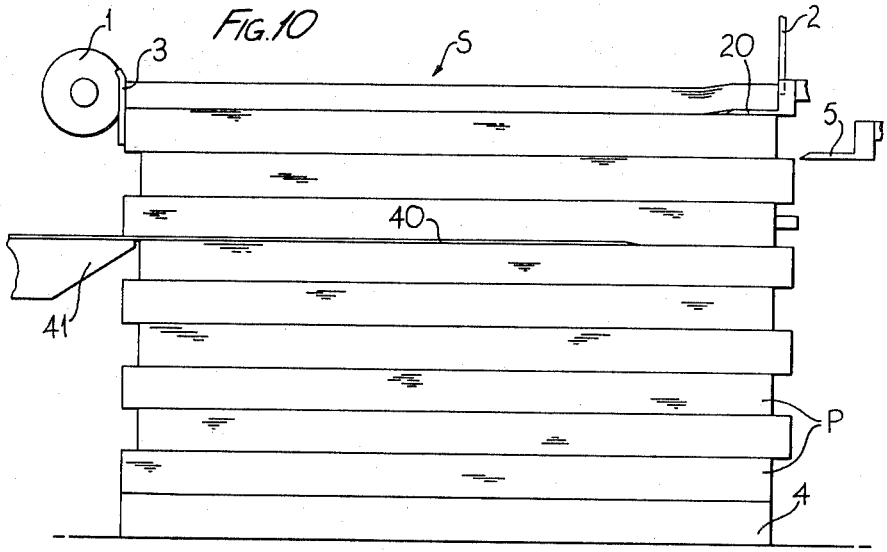

When the portion P forming the top of the stack reaches a position level with the divider plate 40, motor 118 is operated, so as to move divider 40 horizontally to the right between the facing surfaces of the top portion of the required completed stack and the next portion above (FIG. 10). Separation of the completed stack takes place between the top of a portion which has been offset and the bottom of a portion not so offset.

On the divider 40 being inserted into the stack, the pad 157 is moved to the left against the edge of the portion P immediately above the divider 40, by valve 166 being operated so that cylinder 165 moves lever 162 clockwise on its pivot.

As sheets are still being fed on to the top of the stack, the divider 40 and table 41 are moved downwards, with the platform 4, as soon as the divider 40 starts to enter the stack. For this, the motor 127 is operated to rotate sprocket 126 anticlockwise to pay out chain 125, which is kept taut by the combined weights of divider 40, table 41, beams 104 and associated parts, acting to rotate levers 123, 129 on their pivots. The signals from sensor 62 are now also fed, by unit 97 to the motor 127 which thus operates to lower plate 40 and table 41 in unison with platform 4. The pad 157 also moves down with table 41 due to it being supported by the beam 105.

Figure 11:
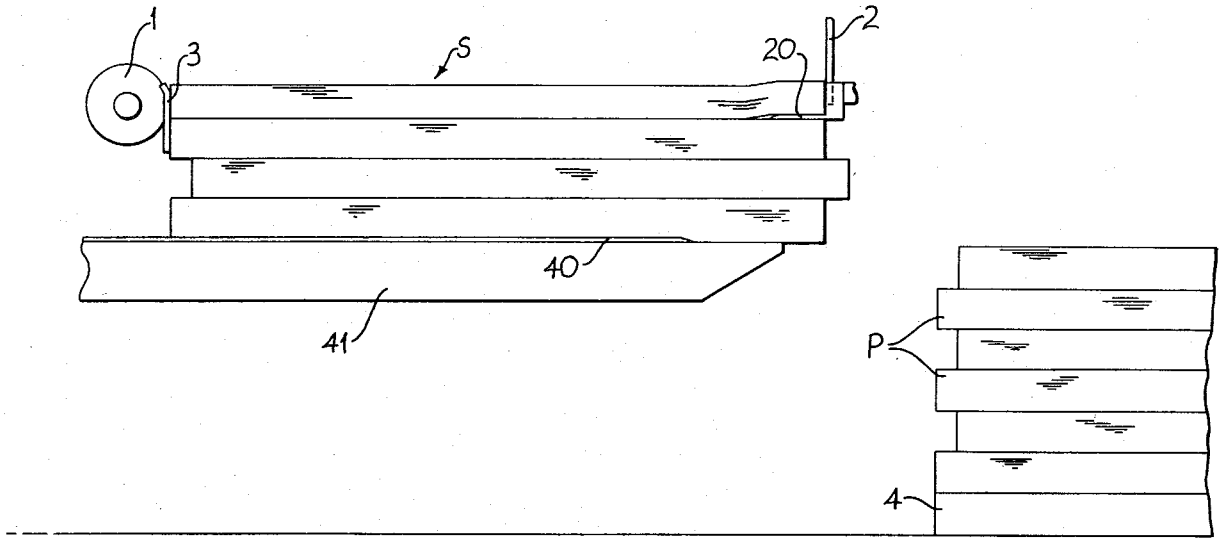

When divider 40 reaches the position shown in FIG. 11, motor 141 is operated to move the table 85, and thus also the completed stack, horizontally to the right. At the same time motor 110 is operated to move the support table 41 also to the right so that the portions P above the stack being removed are supported by table 41 by the time this movement is completed (FIG. 11). The pad 157 prevents the portion P next above divider 40 from also moving to the right during this movement.

Figure 12:
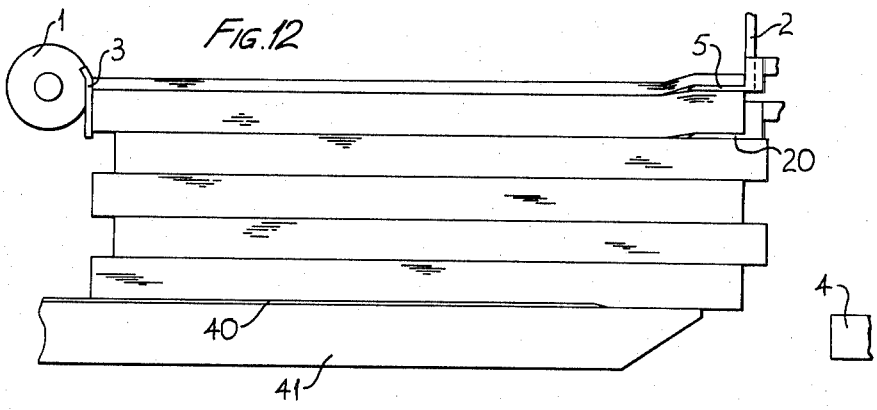
Figure 13:
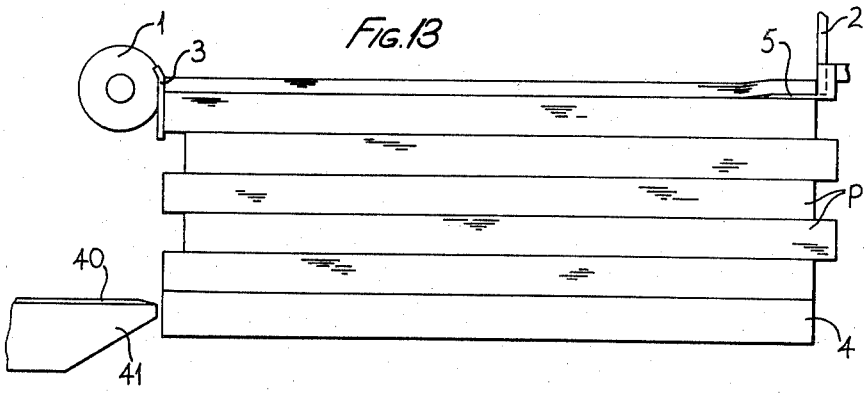

When the various parts reach the positions shown in FIG. 12, valve 166 is operated so that cylinder 165 withdraws pad 157 to the right, pressure air is supplied to chambers 146 (FIG. 8) and out through apertures 145 to provide a layer of air on the upper surface of table 85 and the motor 61 is stopped. Also, motor 14 (FIG. 2B) is operated to drive the conveyor 147 in a clockwise direction so that pushers 148 push the completed stack to the right, off the table 85, after which the motor 154 is stopped and the air supply to chambers 146 is turned off. The stack then has further operations carried out on it as will be described later.

The motor 141 is now operated to move the empty platform 4 to the left to a position to the right of the position it is shown occupying in FIG. 10. Whilst this movement is taking place the motor 154 is operated to drive the conveyors 147 in an anti-clockwise direction to move the pushers 148 back to their starting position shown in FIG. 8.

Motor 61 is now operated to raise the platform 4 such that the upper surface of table 85 is level with the upper surface of the table 41. Motors 141, 110 and 118 are then operated to move divider 40, table 41 and platform 4 together to the left until they occupy the positions shown in FIG. 13, at which time the motor 127 is stopped and the stack being formed is again supported by the platform 4. During this latter movement motor 61 is operated to move the platform 4 downwards again, under the control of sensor 62.

Motor 127 is now operated to rotate sprocket 126 anticlockwise to raise plate 40, table 41 and pad 157 back to the positions shown in FIG. 1.

The above operations for removing a completed stack are repeated after a further stack has been formed as described above with reference to FIGS. 1 to 7.

With reference now to FIG. 15 the completed stacks, after being removed from the table 4, are fed along a conveyor 170 to a transverse conveyor 171 from which the stacks are fed to a machine 172 of any known type which separates each individual portion from the stacks.

Successive portions in each stack are removed therefrom in opposite directions, thus forming two rows 173, 174 of individual portions. Each row of portions is fed respectively to machines 175, 176 which enclose each portion in a carton having a lower body half and an upper lid half. The filled cartons are then shrink-wrapped at 177 and formed into large batches in a palletising unit 178.

I claim:

1. Apparatus for forming a stack from a succession of sheets with alternate portions of the stack being offset by a uniform amount comprising support means on which a stack is to be formed, means for feeding sheets in succession onto said support means, stop means for arresting lengthwise motion of sheets while sheets are fed onto said support means, gripping means for gripping only a portion of said stack, said gripping means including first and second independent gripper plate means each being movable downwardly with a stack, first means for moving at least one of said gripping plate means to offset a gripped portion of a stack relative to the next adjacent portion of a stack, second means for moving said support means downwards as the stack grows so as to keep the top of the stack at a constant level, and third means for separately moving each gripper plate means vertically upwards.

2. Apparatus as claimed in claim 1 including said first and third moving means being operable to move each gripper plate means independently along similar closed paths in a vertical plane so that each gripper plate means moves in succession into said stack, downwards with said stack, out of said stack and upwards, the motions of the gripper plate means being out of phase so that in alternation each gripper plate means changes its vertical position relative to the other gripper plate means, each gripper plate means alternately becoming the upper and lower one.

3. Apparatus as claimed in claim 2 including divider means, fourth means for moving said divider means into the stack at a position between the top of a portion which has been offset and the bottom of a portion not so offset, auxiliary support means, fifth means for moving said auxiliary support means between an inoperative position clear of the stack and an operative support position, wherein the auxiliary support is moved to its operative position immediately below said divider means to support the part of said stack positioned thereabove, and sixth means for moving said support means so as to move the part of said stack, supported thereon below said divider means away from the rest of said stack, as said auxiliary support means is moved to its operative position.

4. Apparatus as claimed in claim 3 further including seventh means for moving said divider and said auxiliary support means downwards in unison with said support means as said divider is inserted into said stack and said auxiliary support means is moved to its operative position.

5. Apparatus as claimed in claim 4 including eighth moving means including pusher means for removing said part of said stack from said support means.

6. Apparatus as claimed in claim 5 including ninth moving means to urge said first and second gripper plate means towards each other to grip the portion between them when both are fully inserted into the stack and the portion between them is to be offset, said ninth moving means being inhibited from urging said gripper plate means towards each other when the portion between them is not to be so offset.

7. Apparatus as claimed in claim 6 including blocking means, tenth means for moving said blocking means into contact with the portion immediately above said divider means as the latter is inserted into the stack, to prevent undesirable movement of said portion, eleventh moving means operable to move downwards said blocking means in unison with said divider and said auxiliary support means whilst said blocking means is in contact with said portion.

8. Apparatus as claimed in claim 7 including a microprocessor, electromagnetic valve means operable to control said third moving means and connected to said microprocessor for operation thereby, to cause said third moving means to move said first and second gripping plate means vertically, clutch means drivingly connected to said first moving means, a first motor drivingly connected to said clutch means and operable by said microprocessor to move said gripper plate means into and out of said stack, counter means connected to said microprocessor and operable to emit pulses indicative of the number of sheets fed to said stack, stack height sensing means connected to said microprocessor and operable to emit pulses thereto for the microprocessor to control said second and said sixth moving means, second electromagnetic valve means operable to control said ninth moving means and connected to said microprocessor for operation thereby, to cause said ninth moving means to grip a portion between said gripper plate means, first transducer means connected to said microprocessor and operable to emit pulses indicative of the vertical position of said support means, a second motor operable by said microprocessor to operate said second moving means and move said support means downwards, second transducer means connected to said microprocessor and operable to emit pulses indicative of the horizontal position of said support means, a third motor operable by said microprocessor to operate said fifth moving means to move said auxiliary support means between its inoperative and operative positions, third transducer means connected to said microprocessor and operable to emit pulses indicative of the horizontal position of said divider means, a fourth motor operable by said microprocessor to operate fourth moving means to move said divider means into and out of said stack, fourth transducer means connected to said microprocessor and operable to emit pulses indicative of the vertical position of said auxiliary support means and said divider means, a fifth motor operable by said microprocessor to operate said seventh moving means to move said auxiliary support means and said divider means vertically, fifth transducer means connected to said microprocessor and operable to emit pulses indicative of the horizonal position of said auxiliary support means, a sixth motor operable by said microprocessor to operate said sixth moving means to move said support means horizontally, sixth transducer means connected to said microprocessor and operable to emit pulses indicative of the position of said pusher means, a seventh motor operable by said microprocessor to operate said eighth moving means to remove said part of said stack from said support means, third electromagnetic valve means operable to control said tenth moving means and connected to said microprocessor for operation thereby, to cause said tenth moving means to move said blocking means into contact with said stack, wherein said microprocessor receives said pulses from said transducer means and is programmed to control the operation of the moving means in a predetermined timed sequence.

* * * * *